United States Patent [19]

Ritzerfeld

[11] 3,942,440

[45] Mar. 9, 1976

[54] METHOD OF MAKING A PRINTING FORM

[76] Inventor: Gerhard Ritzerfeld, Schorlemer Allee 14, 1000 Berlin 33, Germany

[22] Filed: Nov. 12, 1973

[21] Appl. No.: 415,127

[30] Foreign Application Priority Data

Nov. 14, 1972 Germany ..... 2256338

[52] U.S. Cl. ..... 101/401.1; 101/170; 101/467; 250/317; 264/278; 264/322

[51] Int. Cl.[2] ..... B41C 1/00; B41C 3/06

[58] Field of Search ..... 101/467, 470, 471, 401.1, 101/150, 170; 250/316–319; 264/36, 322, 278, 283, 293, 284

[56] References Cited

UNITED STATES PATENTS

| | | | |
|---|---|---|---|
| 522,567 | 7/1894 | Winkel | 101/368 X |
| 2,442,598 | 6/1948 | Harrison et al. | 101/32 X |
| 2,808,777 | 10/1957 | Roshkind | 101/467 X |
| 2,849,752 | 9/1958 | Leary | 101/1 X |
| 3,122,998 | 3/1964 | Raczynski et al. | 101/471 |
| 3,221,654 | 12/1965 | Jernt | 101/401.1 |
| 3,382,798 | 5/1968 | Bishop | 101/401.1 |
| 3,587,459 | 6/1971 | Spencer | 101/128.3 |

FOREIGN PATENTS OR APPLICATIONS

| | | | |
|---|---|---|---|
| 388,443 | 2/1933 | United Kingdom | |
| 1,078,937 | 8/1967 | United Kingdom | 101/32 |
| 990,925 | 5/1965 | United Kingdom | 101/470 |

*Primary Examiner*—Clyde I. Coughenour
*Attorney, Agent, or Firm*—Michael J. Striker

[57] ABSTRACT

A printing form is made by heating a foil of synthetic thermoplastic material and embossing one surface thereof with a plurality of spaced depressions, with the resulting formation at the opposite surface of a corresponding plurality of protuberances.

38 Claims, 19 Drawing Figures

METHOD OF MAKING A PRINTING FORM

BACKGROUND OF THE INVENTION

The present invention relates generally to the printing art, and more particularly to a printing form and to a method and apparatus for making the same.

Printing forms of metal, for instance aluminum, which are embossed so as to have on one surface a plurality of spaced protuberances, are already known in the art. For instance, one such printing form is disclosed in U.S. Pat. No. 3,651,759 (Ritzerfeld) to which reference may be had for details.

Printing forms of this general type have heretofore had the depressions and corresponding protuberances cold-embossed by means of an embossing roller. When the form is to be used for printing purposes, that is when an image area is to be produced which can be printed, then writing was produced on it by means of a typewriter, a ballpoint pen or a scribing tool, or of course a drawing or the like was produced by means of a ballpoint pen or a scribing tool. In so doing, some of the protuberances were flattened out again to thus produce lines or areas which subsequently were to print a desired image corresponding to these lines or areas. A characteristic of these known printing forms provided with protuberances, is that the formation of pictures, drawings, writing or the like was produced purely mechanically by flattening out various of the protuberances. This has the disadvantage that it is impossible to produce the image areas on the printing form from a pattern sheet, for instance a transparent pattern sheet having image areas which could be correspondingly reproduced on the printing form. The image areas always had to be produced by means of a typewriter, scribing tool or the like, and for each printing form the operation of producing the image areas had to be repeated, even though the image areas to be produced on a plurality of printing forms might be identical.

A further disadvantage of the prior-art printing forms of the type here under discussion is the fact that any changes or corrections of the image areas were very difficult to carry out. If an error had been made, or if, after an image area was produced, it had been decided to make a correction, the only way this could be done would be to laboriously deform the material of the printing form again to in effect "erase" or eliminate the previously made deformation which had resulted in the formation of the image area, whereupon in the thus corrected portion of the printing form new protuberances had to be embossed, an operation which was then followed by re-creating the image area in the desired manner.

Still a further drawback of the prior-art printing forms of the type in question was the fact that the aluminum of which they were mostly made is relatively expensive. In some instances the aluminum was combined with layers or coatings of other material, and this has always heretofore made these printing forms relatively uneconomical to use.

Finally, these printing forms of the prior art have still an additional disadvantage, namely the fact that it is very difficult and expensive to provide them with form printing which in many instances is desired as a guide for the later user who is to produce the image area in the printing form, but which form printing must not be embossed into the printing form itself. Such form printing might, for instance, direct a user where to place a street address, a town of residence, telephone number or the like. To do this without at the same time deforming some of the protuberances was very difficult and expensive.

SUMMARY OF THE INVENTION

It is an object of the present invention to avoid the disadvantages of the prior art.

More particularly, it is an object of the invention to provide an improved printing form which is not possessed of these disadvantages.

Another object of the invention is to provide a method of making such a printing form, and of reproducing a printing form which has been provided with desired image areas.

Still another object of the invention is to provide an apparatus for carrying out the method.

In keeping with the above objects, and with others which will become apparent hereafter, one feature of the invention resides in a method of making a printing form which, briefly stated, comprises the steps of heating a foil of synthetic thermoplastic material, and embossing one surface of the foil with a plurality of spaced depressions so as to form at the opposite surface of the foil a corresponding plurality of similarly spaced protuberances.

I have found that a particularly well suited material is polyvinylchloride, and that the foil of synthetic thermoplastic material advantageously should have a thickness of between 0.03 and 0.1 mm, preferably approximately 0.04 mm. The embossing is advantageously carried out by means of an embossing roller, and the heating can be carried out by heating the foil itself or by heating the embossing roller.

The protuberances have the shape of cones, of pyramids or of hemispheres, and measured diagonally of the foil there may be between 15 and 40 protuberances per linear centimeter.

In order to produce image areas on the thusproduced foil, a pattern sheet of paper or synthetic plastic material may be used, which should be transparent and be readily traversable by infrared radiation. Image areas corresponding to those to be produced on the printing form are provided on the pattern sheet, on the front and/or the rear side of the latter, and it is advantageous if these image areas absorb infrared radiation. Infrared radiation is then directed via the pattern sheet at the foil of synthetic thermoplastic material, and as a result of differential heating of the thermoplastic material --i.e. the areas of the foil located opposite the image areas of the pattern sheet become heated to a different extent than the areas which are not located opposite the image areas-- the foil is softened to such an extent that the individual protuberances flow together and form replicas of the image areas on the pattern sheet.

According to a further concept of the invention, a partial vacuum may be created adjacent that surface of the foil which has the protuberances, and during the heating of the foil and, preferably, also during the subsequent cooling thereof, the softened material of the foil is drawn off by the partial vacuum to approximately the level of the tips of the protuberances, that is of the highest points of the protuberances.

I have found that it is advantageous to exert upon the surface of the foil having the protuberances a pressure which is as uniform as possible, during the application of infrared radiation and during the application of the partial vacuum. This pressure can be exerted by means of an elastically yieldable material, for instance rubber or elastically yieldable synthetic plastic. The material may be a cellular material having closed cells to assure that the formation of vacuum between the foil and the material is not destroyed by the fact that air can enter through the material, as would be the case if the material were of the open-cell type. If, however, it is desired for any reason to use foam material of the open-cell type, then the latter is enveloped and gas-tightly sealed in a synthetic plastic sheet material or the like to avoid the aforementioned drawback.

In lieu of the elastically compressible material, it is also possible to locate adjacent the printing form surface in question a chamber which can be pressurized with compressed gas and which is closed off with reference to the surface of the printing foil by an elastically distendable diaphragm or wall that can then be urged against the printing form.

In order to produce a substantially uniform surface from those portions of the printing form which have been softened and raised up or drawn up under the influence of the partial vacuum, it is advantageous to arrange between the pressure-exerting material or diaphragm and the side of the printing form having the protuberances a heatresistant synthetic plastic sheet material of advantageously 0.08 – 0.4 mm thickness which preferably should not absorb infrared radiation.

In some circumstances it may be unavoidable that the pattern sheet is of a type which will not pass infrared radiation, or will not pass it sufficiently for the purposes of the invention. Even under those circumstances the present invention makes it possible to nevertheless reproduce the image areas of the pattern sheet on the printing form, by the so-called reflex method. In this case, the pattern sheet is arranged adjacent the side of the printing form having the protuberance, with its infrared-absorbend image areas facing the protuberance. Infrared radiation is now directed against the printing form which is again softened opposite the image areas of the pattern sheet.

If desired, or if necessary, a gauze or screen of synthetic plastic material can be interposed between the source of infrared radiation and the transparent pattern sheet, or between the source and that surface of the printing form which is embossed with the depressions.

It is self-evident that on one side the printing form having the image areas of the pattern sheet reproduced thereon, will have the image areas in form of reverse-reading images, whereas on the other side it will have the image areas in form of direct-reading images. Printing of the thus-produced printing form can be carried out in two ways.

On the one hand, the side having the reverse-reading images can be inked and the printing form can then be used to print directly onto paper or of course any other desired substance. To do this, the printing form is mounted on the printing cylinder of a printing machine so that the side having the reverse-reading images (i.e. the side having the protuberances) will face outwardly from the printing cylinder.

On the other hand, the printing form may be used for indirect printing. To do this, the side having the direct-reading images is inked and is used to print onto a cooperating medium or element, from which in turn the printed image is transferred to a paper or other material. This latter type of printing can be carried out on all offset machines having a stationary or exchangeable offset medium or element, and moistening is not necessary in this case since the printing can be carried out in effect as a dry-offset printing. In this case the image areas are produced on the printing form by juxtaposing with that surface that has the depressions formed in it a pattern sheet which is formed on its side facing the printing form with infrared-absorbent image areas. Infrared radiation is then directed at the printing form to locally soften the same sufficiently so that the protuberances in the portions of the printing form opposite the image areas of the pattern sheet can flow together, aided by the vacuum or pressure which may be applied in the manner outlined earlier. This produces a direct-reading replica of the image areas from the pattern sheet on the printing form, and this replica can then be printed in the manner just outlined.

The arrangement for carrying out the method of the present invention advantageously utilizes a flat table which may be transparent and will pass infrared radiation. This may be in form of a glass plate or the like onto which the embossed foil and the pattern sheet can be placed. An infrared radiation source is provided, and the table and source may be arranged so that they can be moved with reference to one another. A cooling device is also provided. According to the invention, a cover is provided which can be moved to and from a position in which it overlies the printing form on the supporting table. The cover is provided with a vacuum arrangement which produces between the printing form and the cover a partial vacuum while at the same time engaging a circumferentially extending marginal portion of the printing form so as to seal the space between the latter and the cover.

It is advantageous if an elastically yieldable and compressible material is provided in the cover, which exerts a substantially uniform pressure upon the printing form when the cover is in its closed position overlying the printing form. As pointed out earlier, it is advantageous if the material is a closed-cell foam material which is inserted into or secured to the cover. However, an opencell foam material can also be used if it is enveloped and gas-tightly sealed into a synthetic plastic sheet material or the like which is gas impermeable.

It is advantageous if a sheet material of synthetic plastic, paper or cardboard which does not absorb infrared radiation is placed between the side of the printing form having the protuberances and the pressure-exerting elastically yieldable material. This sheet, is made of synthetic plastic material, may have resistance heating wires embedded in it to provide additional heat for the printing form.

If desired, the cover may be provided —in lieu of the elastically yieldable material— with a chamber having an open side facing the printing form and covered by an elastically distendable diaphragm or wall. The interior of this chamber can then be pressurized with compressed gas such as air, and it will be the diaphragm or elastically distendable wall which will exert the substantially uniform pressure upon the printing form.

To produce the pressure and/or the vacuum an arrangement for creating such pressure and/or vacuum can be provided, for instance in form of appropriate pressure or suction pumps. It is also possible to provide the arrangement with a valve-controlled surge tank or blast box to produce a substantially instantaneous pressure or suction effect.

Since the suction effect depends upon the engagement of a circumferentially extending marginal portion of the printing form by the sealing means on the cover, and since it may be desired to simultaneously process printing forms of different sizes, the apparatus may be provided with covers which are arranged adjacent one another on the supporting table but are of different sizes, one or more for each printing form size to be processed.

The printing form itself according to the present invention is advantageously of a synthetic thermoplastic material having a low softening point, for instance polyvinylchloride. It may have a thickness of between substantially 0.03 mm and 0.07 mm, and the protuberances formed in it may be conical, pyramidal or hemispherical. The density of the protuberances may be approximately 15 – 40 protuberances per linear centimeter measured diagonally of the printing form, and the height to which the protuberances project beyond the associated surface of the printing form may be between substantially 0.03 mm and 0.08 mm.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
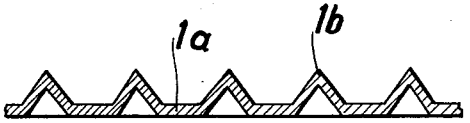
FIG. 1 is a fragmentary section, on an enlarged scale, through a printing form according to the present invention which is ready to be provided with image areas.

Referring now firstly to FIG. 1, it will be seen that this shows a fragmentary section through a printing form produced in accordance with the present invention. The printing form has a body of polyvinylchloride thermoplastic foil, and it will be assumed that in this embodiment the thickness of the foil 1*a* is approximately 0.4 mm. One side of the foil, the one facing downwardly in FIG. 1, is provided with a plurality of spaced depressions as a result of which the other side (the side facing upwardly in FIG. 1) is provided with a plurality of corresponding similarly spaced protuberances 1*b* which in this embodiment are of conical shape.

Figure 2:
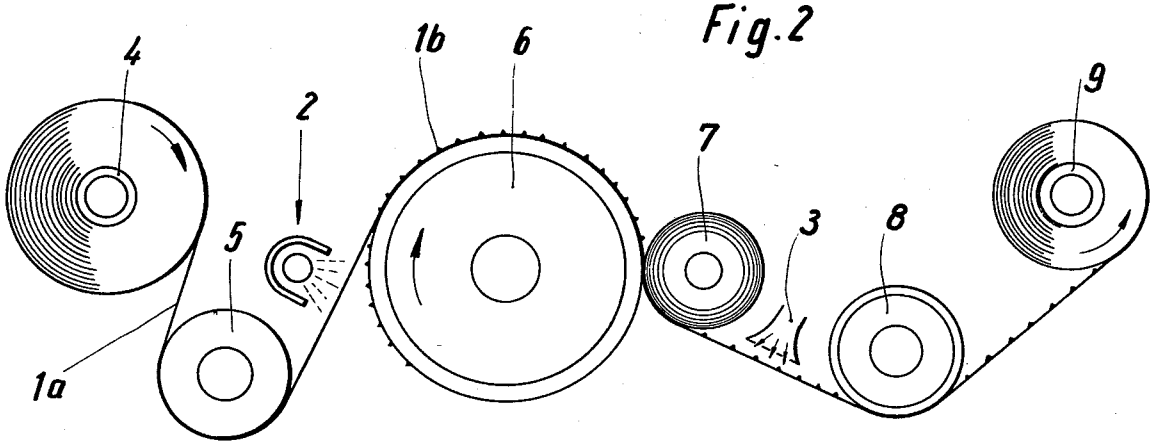
FIG. 2 is a diagrammatic side view illustrating an arrangement for making the printing form shown in FIG. 1.

The printing form according to FIG. 1 can be produced in the manner suggested in FIG. 2, where the foil 1*a* is withdrawn from a supply roll 4 and advanced via a guide roller 5 past a source of heat 2 and around an embossing roller 6 which is formed on its periphery with projections which form in the material of the foil 1*a* which has been softened by the heat source 2, the embossments or protuberances 1*b*. The thus-embossed foil 1*a* is then advanced via the guide rollers 7 and 8 and the cooling device 3 (for instance an air blower) to a take-up roll 9. It is rolled up onto this roll 9 and can later be cut to the desired size.

Instead of forming the protuberances 1*b* so as to have the conical configuration shown in FIG. 1, they may also be given a pyramidal shape or a hemispherical shape.

Seen diagonally of the printing form, that is of the plastic foil 1*a*, the density of protuberances 1*b* can be between substantially 15 and 40 per linear centimeter. The number may be smaller or greater, but the range just mentioned has been found to produce the most acceptable results when the form is later used for printing.

Figure 3:
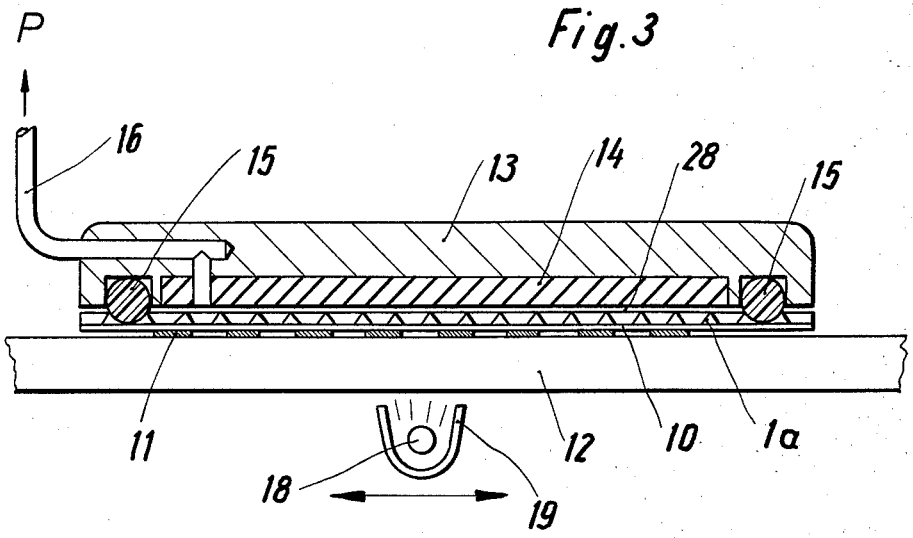
FIG. 3 is a diagrammatic vertical section showing one embodiment of an arrangement for providing the embossed printing form with image areas.
Figure 4:
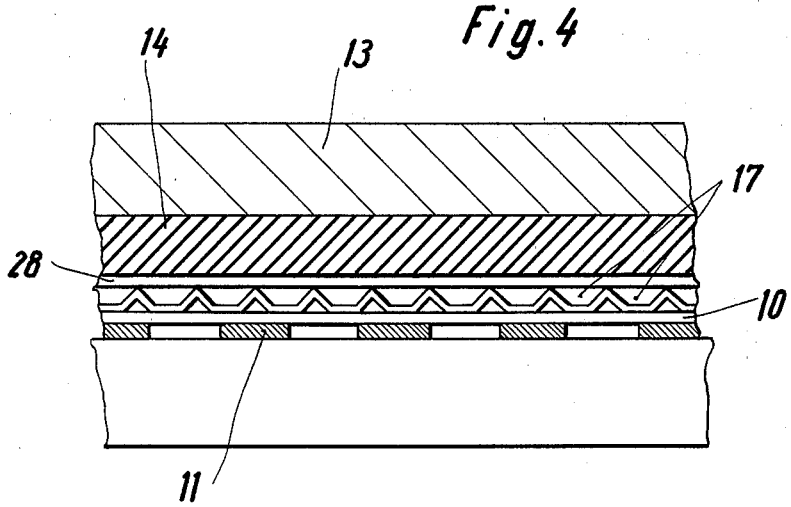
FIG. 4 is an enlarged sectioned fragmentary detail view of FIG. 3.

FIGS. 3 and 4 show one embodiment of an apparatus for providing the form shown in FIG. 1 and produced in accordance with FIG. 2, with image areas which are subsequently to be printed. In FIGS. 3 and 4 a transparent pattern sheet 10 of paper or synthetic plastic material has image areas 11 and is so positioned that these image areas 11 face towards the glass plate 12 which serves as the supporting table of the apparatus. The pattern sheet 10 is placed onto the plate 12 and the image areas 11 should be understood to be infrared-absorbend whereas the remainder of the pattern sheet 10 is not. The printing foil 1*a* is placed onto the pattern sheet 10 so that its protuberances 1*b* face upwardly away from the latter towards a resiliently yieldable insert 14 which is arranged in a cover 13 of the apparatus and whose purpose it is to exert substantially uniform pressure upon the printing form 1*a* and the pattern sheet 10. In addition, although not necessarily so, a heat-resistant synthetic plastic sheet material 28 (having for instance a thickness of approximately 0.08 mm – 0.4 mm and being of a material which does not absorb infrared radiation) can be placed between the insert 14 and the side 17 of the printing foil 1*a* which is formed with the protuberances 1*b*.

In the illustrated embodiment the cover 13 is hingedly mounted, although of course it could be made removable in other ways. It is provided with a heatresistant sealing element 15 which, when the cover is in the illustrated position, presses against the circumferentially extending marginal portion of the printing form 1*a* to form a seal with the same. A conduit 16 connects the space between the printing form 1*a* and the cover 13 with a diagrammatically illustrated pump P (shown only in FIG. 3) which produces adjacent the side 17 a partial vacuum. A source 18 of infrared radiation, provided with a reflector 19, is arranged beneath the plate 12 and can be moved as indicated by the double-headed arrow (see FIG. 3) so that the printing form 1*a* will be differentially heated by the radiation emitted from the radiator 18. This results in a flowing of the material of those protuberances which are heated to the greatest extent, and the thus-softened material is drawn up against the plstic sheet 28 by thee action of the vacuum, so that a raised mirror image or reverse-reading image of the image areas 11 is produced at the side 17 of the printing form 1*a*.

Figure 5:
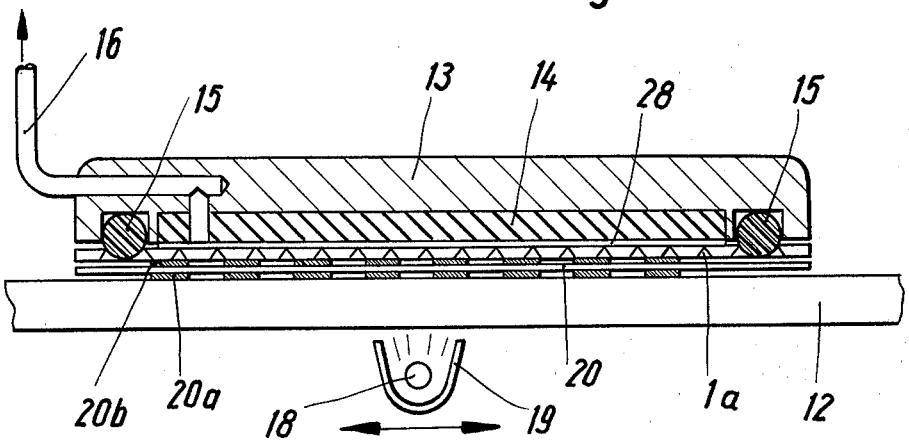
FIG. 5 is a view similar to FIG. 3, but illustrating a further embodiment of the invention.
Figure 6:
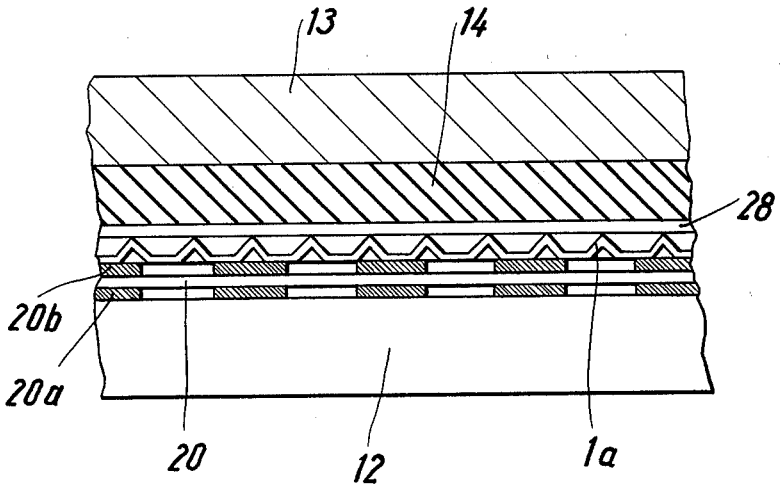
FIG. 6 is a view similar to FIG. 4, but illustrating a detail of FIG. 5.

The arrangement shown in FIGS. 3 and 4 is used in conjunction with an apparatus which is to be described later with reference to FIGS. 15 and 16. FIGS. 5 and 6 show a somewhat different embodiment wherein a pattern sheet 20 of paper or synthetic plastic material is provided which is transparent and readily permits the passage therethrough of infrared radiation. The front side of the pattern sheet 20 is provided with direct-reading image areas 20*a* and the reverse side is provided with reverse-reading image areas 20*b*, with both the areas 20*a* and 20*b* serving to absorb infrared radiation. This arrangement, which otherwise is the same as and operates in the same manner as the one in FIGS. 3 and 4, produces a better transmission of heat to the printing form 1*a*.

Figure 7:
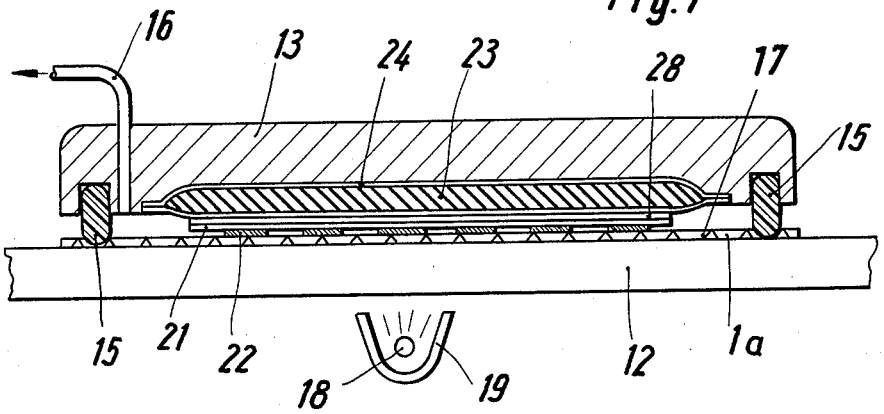
FIG. 7 is a view similar to FIG. 3, illustrating an additional embodiment of the invention.
Figure 8:
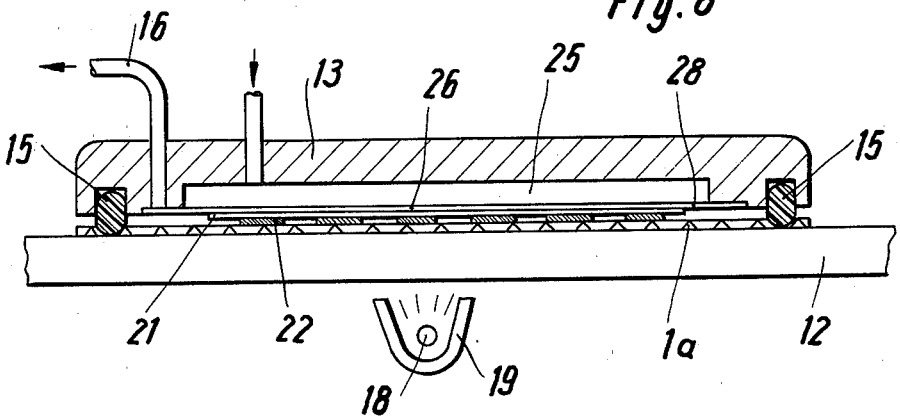
FIG. 8 is a view similar to FIG. 3, illustrating a further embodiment of the invention.
Figure 9:
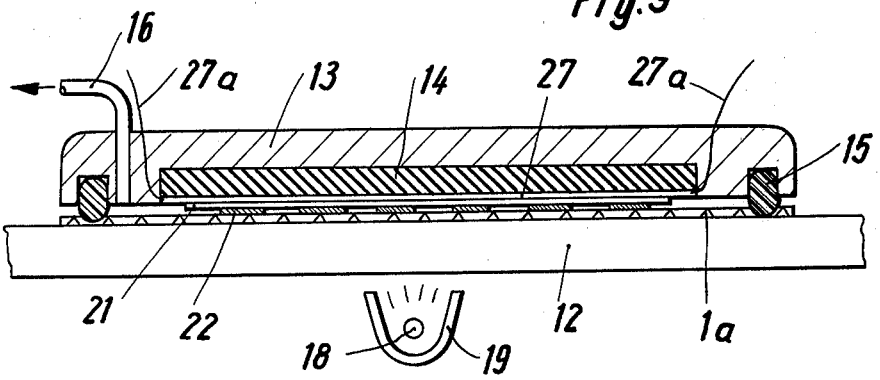
FIG. 9 is another view similar to FIG. 3, illustrating an additional embodiment of the invention.

FIGS. 7, 8 and 9 show how the printing form 1*a* can be provided with image areas by the reflex method. This is necessary if the pattern sheet is not transparent. FIGS. 7–9 all show that here the side 17 of the printing form faces upwardly away from the glass plate 12, as before, but that the non-transparent pattern sheet 21 is located above the side 17, being provided with infrared radiation absorbent image areas 22 which face the protuberances of the printing form 1*a*. In FIG. 7 the resiliently yieldable insert 23 is a material which is of open-cellular foam character, and which for this reason is enveloped and gas-tightly sealed in synthetic plastic sheet material 24. As before, its purpose is to exert a substantially uniform pressure upon the printing form 1*a* and the pattern sheet 21.

FIG. 8 is analogous to FIG. 7, except that the material 23 of FIG. 7 is replaced in FIG. 8 by a pressure chamber 25 to which compressed air can be admitted in the illustrated manner, and the open side of which faces the printing form 1*a* and is spanned by an elastically distendable diaphragm or wall 26. It is self-evident that when compressed air is admitted into the chamber above the diaphragm 26, the latter will exert a substantially uniform pressure upon the printing form 1*a*.

The embodiment of FIG. 9 differs from the preceding embodiments in that between the side 17 of the printing form 1*a* and the resiliently yieldable material 14 there is located a layer 27 —advantageously of synthetic plastic material which does not absorb infrared radiation but is heat-resistant— wherein resistance-heating wires are embedded (not shown) the terminals of which are identified with reference numerals 27*a*. This facilitates heating of the printing form 1*a*.

Figure 10:
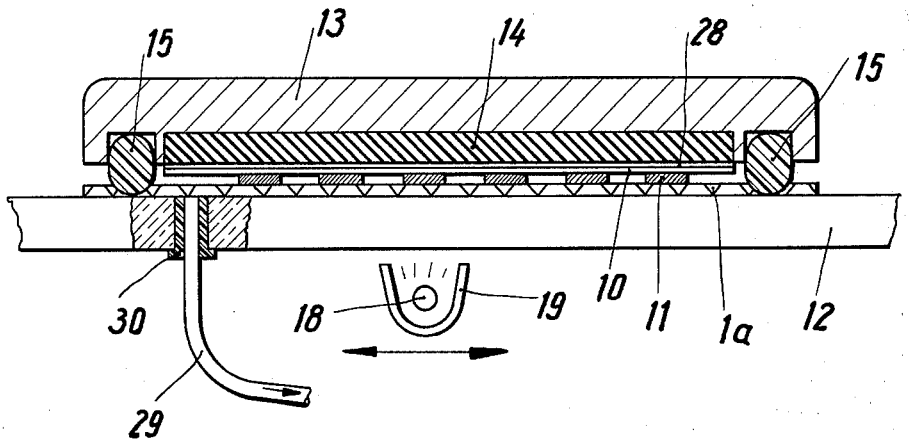
FIG. 10 is a view similar to FIG. 9, illustrating still a further embodiment of the invention.

FIG. 10 shows an embodiment wherein the printing form 1*a* is again supported on the glass plate 12, but here with its side 17 having the protuberances 1*b* facing downwardly towards the plate 12. Located above the printing form 1*a* is the pattern sheet 10 the infrared radiation absorbent image areas 11 of which face towards the printing form 1*a*. Reference numeral 29 identifies a conduit which passes through a bore in the plate 12 by means of a bushing 30 and which is connected in the manner suggested in FIG. 3 with a pump P (not shown) capable of producing a partial vacuum between the plate 12 and the printing form 1*a*, for which purpose the sealing means 15 is again provided. In all other respects this embodiment is the same as for instance the embodiment of FIG. 3 and it will be appreciated that the printing form 1*a* will be provided with a raised mirrow-reversed replica of the image areas 11 when this vacuum is applied and when the printing form 1*a* is heated differentially via the source 18.

Figure 11:
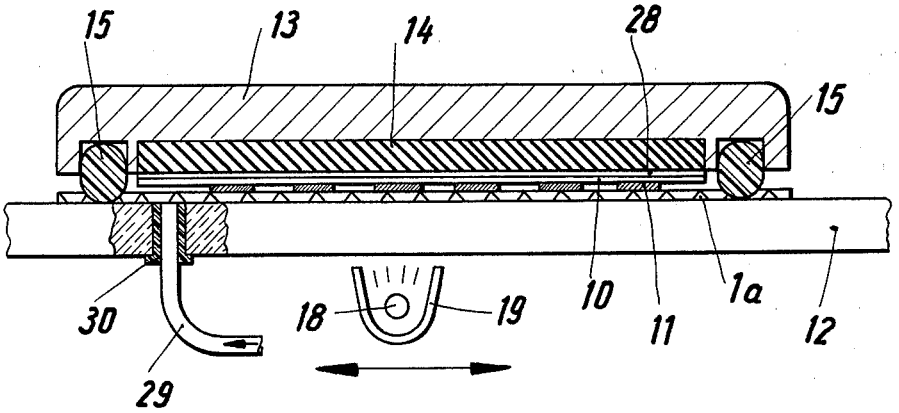
FIG. 11 illustrates the embodiment of FIG. 10 in operation.

In FIG. 11 the position of the printing form 1*a* with respect to the glass plate 12 is reversed, that is the protuberances face upwardly. Located above the printing form 1*a* is the pattern sheet 10 the infrared-radiation absorbent image areas 11 of which face the printing form 1*a*. In this embodiment, the conduit 29 should be understood to be connected to a source of pressure (non-illustrated) so that a pressure can be produced beneath the printing form 1*a*, which causes the material which is locally softened opposite the image areas 11, to be pushed up and raised approximately to the highest level of the protuberances of the printing form, producing a raised mirror-reversed or reverse-reading image.

Figure 12:
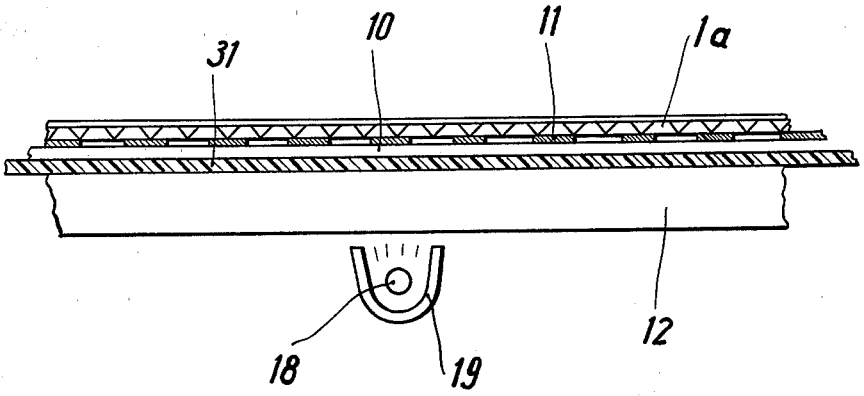
FIG. 12 is a view similar to FIG. 10 but showing yet a further embodiment of the invention.

The embodiment of FIG. 12 shows an arrangement wherein a gauze or screen 31 of synthetic plastic material is placed between the plate 12 and the embossed side of the printing form, that is the side which is not provided with the protuberances, in order to produce an air-cushion. In other respects this embodiment corresponds to preceding ones.

Figure 17:
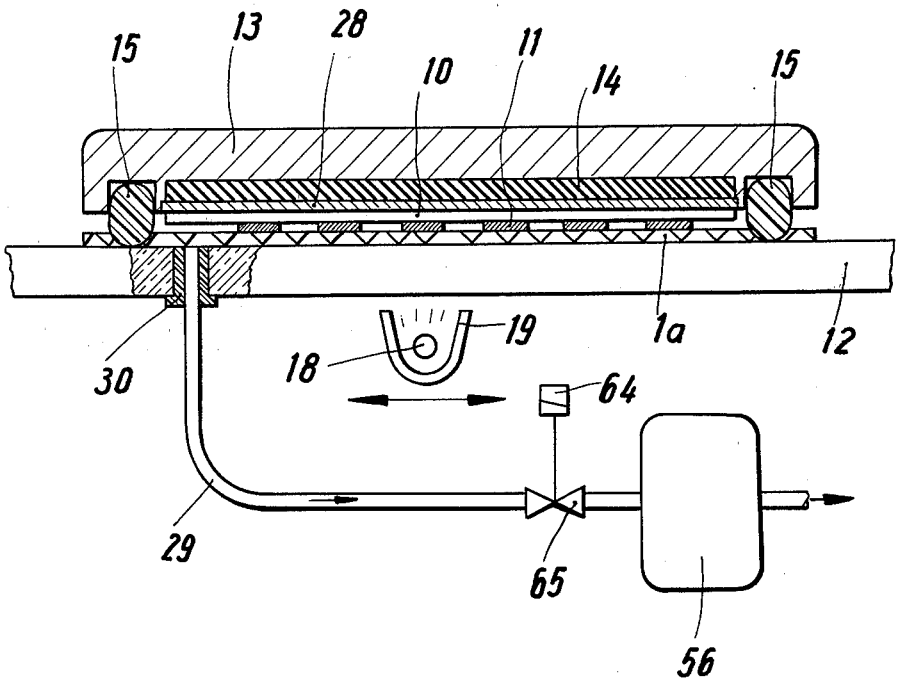
FIG. 17 is a view similar to FIG. 10, showing an additional embodiment of the apparatus.

FIG. 17 shows an arrangement analogous to FIG. 10, wherein however a blast box 56 is provided which is connected with the conduit 29 by means of an electromagnetically controlled valve 65 (note the solenoid 64) to produce a substantially instantaneous suction in the conduit 29 (as shown in FIG. 170 or, if the blast box 56 produces pressure, to produce substantially instantaneous pressure in the conduit 29, in which case the blast box would be used in the arrangement of FIG. 11.

Figure 13:
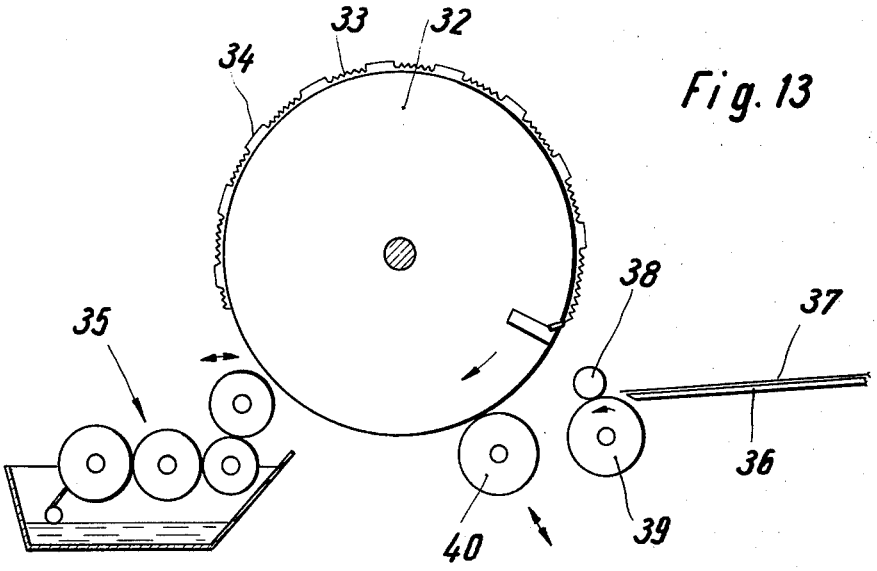
FIG. 13 is a diagrammatic side view illustrating a rotary printing machine with a printing form mounted so that the reverse-reading images thereof face outwardly.

Coming now to FIG. 13 it will be seen that this shows one arrangement for printing the printing form which has been produced and has been given the image areas to be printed. FIG. 13 shows a rotary duplicator having a printing cylinder 32 on which the printing form 33 is mounted so that its reverse-reading images 34 face outwardly. These images are inked by the diagrammatically illustrated inking arrangement 35 which is well known to those skilled in the art. When the inked printing form subsequently cooperates with the roller 40, to which paper or similar sheets 37 are supplied from a support 36 via the rollers 38, 39, it will print directly onto the sheets 37.

Figure 14:
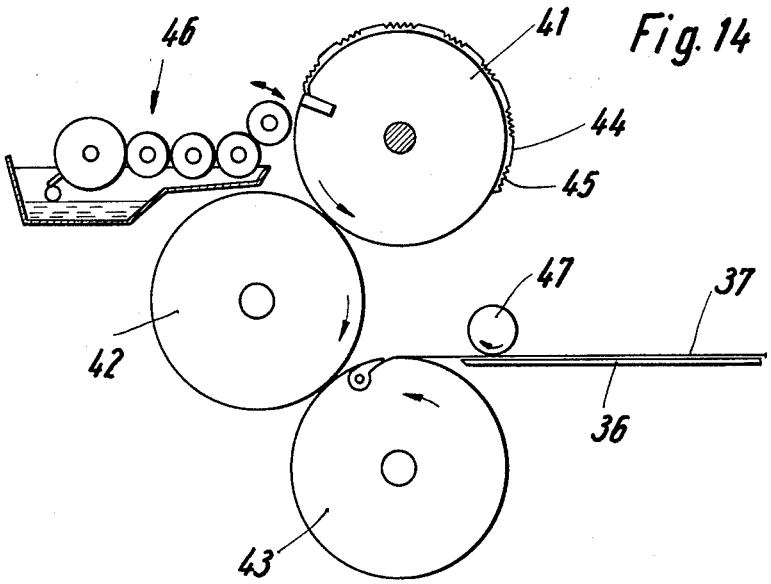
FIG. 14 is a view similar to FIG. 13, but showing the printing form with its direct-reading images facing outwardly.

FIG. 14 shows an arrangement wherein the printing from the printing form onto the sheets 37 is indirect. The illustration in FIG. 14 is of an offset machine having a printing form cylinder 41, an offset cylinder 42 and a pressure cylinder 43. The printing form is identified with reference numeral 45 and mounted on the cylinder 41 so that its direct-reading image area 44 faces outwardly. The image area 44 may be produced for instance in accordance with the embodiment of FIG. 10. The printing form 45 is again inked by the inking arrangement 46 and prints onto the offset cylinder 42, which in turn prints onto the sheets 37 which are supplied by roller 47 and passed between the cylinder 42 and the cylinder 43.

Figure 15A:
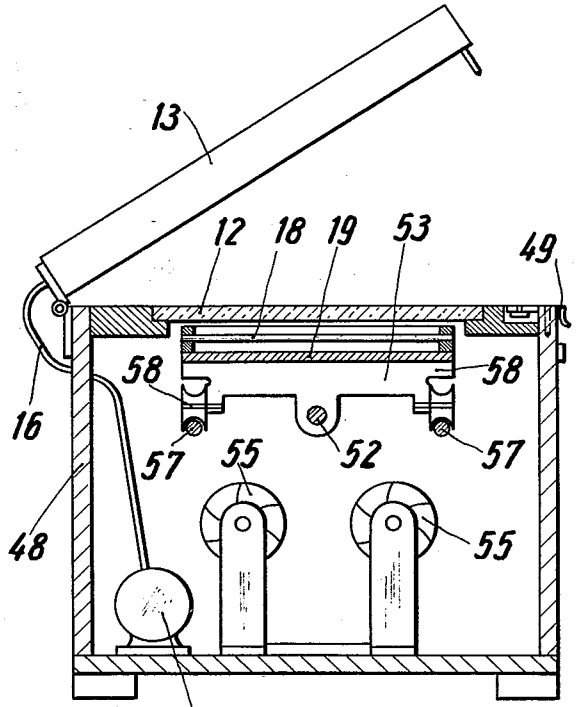
FIG. 15*a* is a cross-sectional through FIG. 15.
Figure 15:
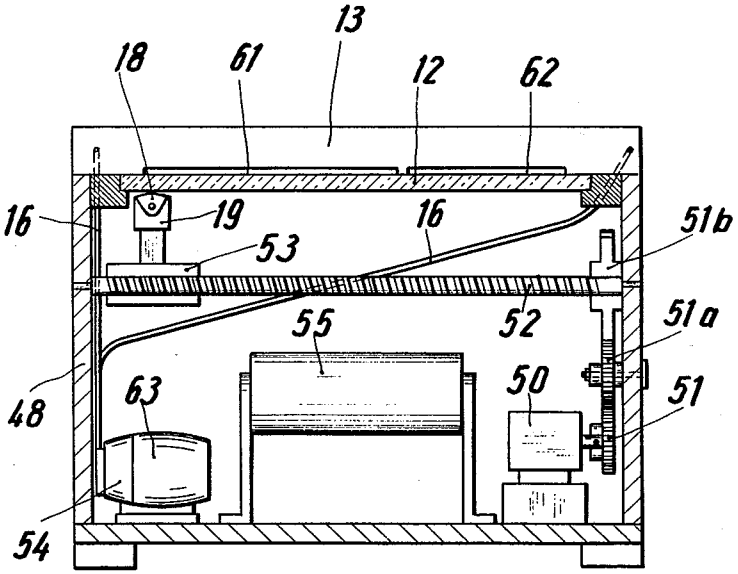
FIG. 15 is an apparatus, shown in partly sectioned somewhat diagrammatic view, for making printing forms of different sizes.
Figure 16A:
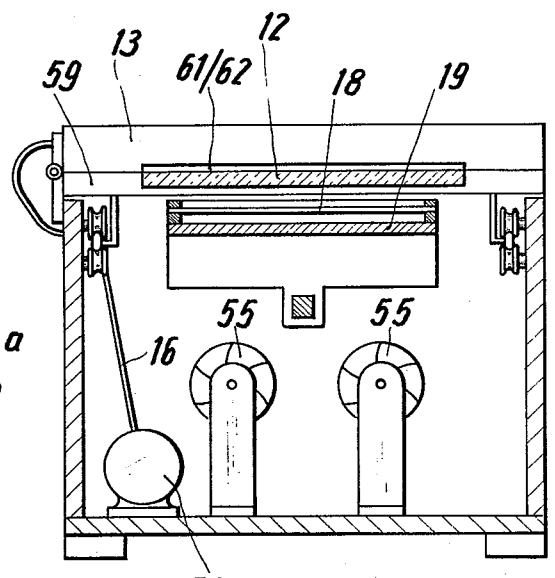
FIG. 16*a* is a cross-sectional through FIG. 16.
Figure 16:
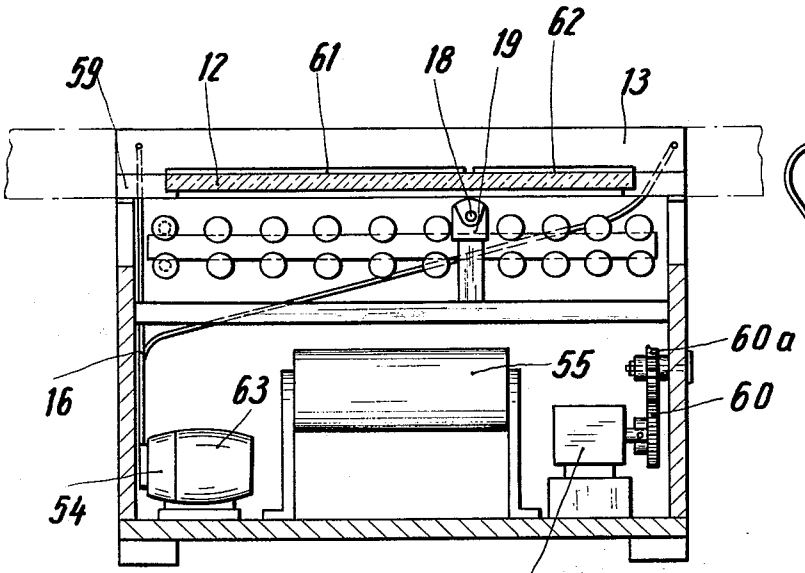
FIG. 16 is a view similar to FIG. 15, illustrating a further embodiment of the apparatus.

FIGS. 15 and 15*a* show one complete arrangement for carrying out the invention, and FIGS. 16 and 16*a* show another different arrangement.

Referring firstly to FIGS. 15 and 15*a* it will be seen that reference numeral 48 identifies a housing on which a cover 13 is pivotally mounted. The cover 13 can be held in its closed position by the arrangement 49 when a vacuum or a pressure is to be produced. The pressure-exerting material 14 or 23 (not shown) of, for instance FIGS. 3 or 7, will be provided in the cover 13. A flexible conduit 16 connects the interior of the cover 13 with the pump 54 which produces a vacuum or a pressure.

The glass plate 12 is stationarily mounted in the housing 48 and located beneath it is a motor 50 which turns a spindle 52 via a reversing drive 51, 51*a* and 51*b*. In so doing, it moves the infrared radiator 18 with its reflector 19 to and fro in a horizontal path, the radiator 18 being mounted on a support 53 which is held on the spindle 52.

After a partial vacuum has been produced between the cover 13 and the plate 12, the motor 50 is energized and at the same time the radiator 18 is switched on. The radiator 18 now moves to and fro in horizontal direction along the spindle 52, whereby the printing form 1*a* (not shown, but arranged for instance in the manner shown in FIG. 3) will be differentially heated. Below the radiator 18 are provided cooling devices such as blowers 55, which prevent the arrangement from becoming overheated and which serve to cool the printing form sufficiently after it has been heated, so that it again loses its plasticity. The pump 54 can be replaced with the blast box 56 which has already been discussed with respect to FIG. 17. To assure precise guidance of the radiator 18, rollers 58 are associated with the support 53 which slide on shafts 57 as seen in FIG. 15*a*.

Coming, finally, to the embodiment in FIGS. 16 and 16*a* it will be seen that this is reminiscent of the one in FIGS. 15 and 15*a*. However, in FIGS. 16 and 16*a* the radiator 18 and its reflector 19 are mounted stationarily, whereas the cover 13 with the plate 12 and the material 14 or the like is mounted on a carriage 59. The motor 50 and the reversing drive 60, 60*a* moves the carriage 59 with the cover 15 either towards the left or towards the right, depending upon whether a printing form of larger size such as 61 or of smaller size such as 62 is to be produced.

After the motor 63 is energized, the pump 54 is switched on and a vacuum is produced via the conduit 16. Thereupon, the carriage 59 is driven by the motor 50 and the radiator 18 is switched on. The latter can, incidentally, be pre-heated in known manner.

In FIGS. 15, 15*a* as well as 16, 16*a* the resistance-heated foil 27 of FIG. 9 can be employed, if it is desired to increase the heating effect upon the printing form.

If two differently dimensioned types of printing forms are to be produced, it would be possible instead of the arrangement of FIGS. 16 and 16*a* to separate the cover and provide for each size a different cover with the associated components.

It should be appreciated that the exemplary embodiments which have been disclosed herein are not intended to be considered limiting in any sense. In particular it should be understood that techniques used in thermocopying apparatus, particularly flat-table thermocopying apparatus, can be used to advantage in conjunction with the present invention without, however, departing from the inventive concept.

It is a particular advantage of the present invention that it makes it possible for the first time to use transparent or non-transparent pattern sheets of papers or synthetic plastic material, whereon the image areas to be provided on the printing form and subsequently to be printed with the latter, can be readily produced. Moreover, these image areas can be readily corrected or changed by the use of appropriate chemicals or even by the use of a conventional eraser. Using a single such pattern sheet, any desired number of printing forms can be produced according to the present invention in a very simple rapid and reliable manner, and at economically most attractive cost. This means that the present invention opens up applications which heretofore were considered closed to this type of printing form. In particular, this invention makes it possible to use letter press printing apparatus and inking devices which have been found to be particularly reliable and require only a minimum of maintenance and supervision. Moreover, the use of synthetic plastic material for the printing form substantially reduces the expenses involved in producing the same, and at the same time eliminates the difficulties of the prior art in terms of deformation of image areas on the printing form and the correction of any errors of the carrying-out of changes inn the image areas.

It will be understood that each of the elements described above, or two or more together, may also find a useful application in other types of constructions differing from the types described above.

While the invention has been illustrated and described as embodied in thermoplastic printing forms, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A method of making a printing form comprising the steps of providing an embossable foil; embossing the foil to form a multiplicity of depressions in one surface which are distributed over said one surface and similarly distributed protuberances which project from the opposite surface of the foil; placing the free ends of said protuberances in contact with an abutment face; differentially heating said foil in accordance with a predetermined pattern and thereby causing differential softening of the foil in accordance with said pattern; and applying to said protuberances a uniform pressure causing at least partial flattening of the protuberances in at least one softened region of said foil to form on said other surface a replica of said predetermined pattern, whereby the foil is converted into a relief printing form.

2. A method as defined in claim 1, wherein said foil comprises polyvinylchloride having a thickness of between 0.03 mm and 0.1 mm.

3. A method as defined in claim 1, wherein said foil comprises polyvinylchloride having a thickness of 0.04 mm.

4. A method as defined in claim 1, wherein the step of embossing comprises contacting said foil under pressure with an embossing roller, and transmitting heat to said embossing roller.

5. A method as defined in claim 1, wherein the step of embossing comprises forming between 15 and 40 of said depressions and corresponding protuberances in said foil per lineal centimeter in direction diagonally of said foil.

6. A method as defined in claim 1, wherein the step of embossing comprises forming said depressions so that said protuberances have the shape of pointed cones, pyramids or hemispheres.

7. A method as defined in claim 1, wherein said foil comprises a thermoplastic material.

8. A method as defined in claim 1, wherein said heating is performed by arranging one side of said foil in overlapping relationship with a transparent pattern sheet which permits the passage of heat radiation and is provided with image areas arranged in said predetermined pattern which absorb heat radiation, and directing heat radiation at said foil via said pattern sheet so that first portions of said foil which are located opposite said image areas become heated to a greater extent than the remaining second portions of said foil due to the absorption of heat radiation by said image areas which results in heating of the latter to higher temperatures than the remainder of said pattern sheet and which also results in a flowing-together of the protuberances in said first portions to form said replica.

9. A method as defined in claim 1, wherein said heating is performed by arranging said opposite surface of said foil in overlapping relationship with a pattern sheet having on its side facing said opposite surface infrared absorbing images arranged in said predetermined pattern, and directing infrared radiation at said opposite surface of said foil via said pattern sheet so that portions of said foil which are located opposite said image areas become heated and softened and the material of the protuberances which are located in said portions flow together to form said replica.

10. A method as defined in claim 1, said heating being performed by arranging one side of said foil in overlapping relationship with a pattern sheet having infrared absorbing image areas arranged in said predetermined pattern, and directing infrared radiation from a source at said foil via said pattern sheet so that portions of said foil which are located opposite said image areas become heated and softened and the material of the protuberances which are located in said portions flows together to form said replica; and wherein an apertured sheet of synthetic plastic material is interposed between said foil and said source.

11. A method as defined in claim 1, said heating being performed by arranging said one surface of said foil in overlapping relationship with a pattern sheet having a side which is directed towards said one surface and is provided with infrared absorbing image areas arranged in said predetermined pattern, and directing infrared radiation from a source at said foil via said pattern sheet so that portions of said foil which are located opposite said image areas become heated and softened and the material of the protuberances which are located in said portions flows together to form said replical.

12. A method as defined in claim 1, wherein said heating is performed by arranging said one surface of said foil in overlapping relationship with a pattern sheet having a side which is directed towards said one surface and is provided with infrared absorbing image areas arranged in said predetermined pattern, and directing infrared radiation at said foil from the side of the latter which is provided with said protuberances thereby causing portions of said foil which are located opposite said image areas to become heated and softened so that the material of the protuberances which are located in said portions flows together to form said replica.

13. A method as defined in claim 1, said heating being performed by supporting said foil on a transparent supporting member and directing radiation at said foil through said member; and wherein a porous element of synthetic plastic material is interposed intermediate said member and said foil.

14. A method as defined in claim 13, wherein said foil is arranged with said one surface facing away from said member.

15. A method as defined in claim 13, wherein a substantially transparent pattern sheet provided with radiation absorbing image areas arranged in said predetermined pattern is interposed between said foil and said element thereby causing portions of said foil which are located opposite said image areas to become heated and softened so that the material of the protuberances which are located in said portions flows together to form said replica.

16. A method as defined in claim 1, wherein said heating is performed by arranging one side of said foil in overlapping relationship with a pattern sheet provided with image areas arranged to form said predetermined pattern, and directing radiation towards said foil.

17. A method as defined in claim 16, wherein said foil is arranged intermediate said pattern sheet and the radiation source.

18. A method as defined in claim 16, wherein said pattern sheet is arranged intermediate said foil and the radiation source.

19. A method as defined in claim 16, wherein said pattern sheet is arranged on the side of said foil having said depressions.

20. A method as defined in claim 16, wherein said pattern sheet is arranged on the side of said foil having said protuberances.

21. A method as defined in claim 16, wherein the step of arranging comprises utilizing a pattern sheet only one side of which is provided with image areas.

22. A method as defined in claim 16, wherein the step of arranging comprises utilizing a pattern sheet of paper.

23. A method as defined in claim 16, wherein the step of arranging comprises utilizing a pattern sheet of a synthetic plastic substance.

24. A method as defined in claim 16, wherein the step of arranging comprises utilizing a pattern sheet having oppositely directed sides each of which is provided with image areas.

25. A method as defined in claim 24, and comprising the step of elevating the temperature of said foil during said embossing.

26. A method as defined in claim 24, wherein the step of applying comprises subjecting said foil to a negative pressure during said heating.

27. A method as defined in claim 24, wherein the step of applying comprises subjecting said foil to a positive pressure during said heating.

28. A method as defined in claim 24, wherein the step of applying comprises exposing said opposite surface of said foil to a negative pressure during said heating so that portions of said foil which are sufficiently softened by said heating and which are at a level different from that of the tips of said protuberances are drawn to approximately the level of said tips to form said replica.

29. A method as defined in claim 24, said heating being performed by arranging one side of said foil in overlapping relationship with a transparent pattern sheet which permits the passage of infrared radiation and is provided with image areas arranged in said predetermined pattern which absorbs infrared radiation, and directing infrared radiation at said foil via said pattern sheet so that portions of said foil which are located opposite said image areas become heated and softened; and wherein the step of applying comprises exposing said opposite surface of said foil to a vacuum so as to draw said portions upwardly to substantially the level of said protuberances while permitting said protuberances of said portions to flow together and form said replica.

30. A method as defined in claim 24, wherein the step of applying comprises exerting pressure on said protuberances with an elastically yieldable element during said heating.

31. A method as defined in claim 30, wherein said elastically yieldable element comprises closed-cell foam material.

32. A method as defined in claim 30, wherein said yieldable element comprises an elastic diaphragm which is biased towards said protuberances by gas pressure.

33. A method as defined in claim 30, wherein a heat-resistant synthetic plastic layer which does not absorb infrared radiation is interposed between said element and said protuberances.

34. A method as defined in claim 30, wherein a heat-resistant synthetic plastic layer of substantially 0.08 – 0.4 mm thickness is interposed between said element and said protuberances.

35. A method as defined in claim 30, wherein said elastically yieldable element comprises open-cell foam material which is gas-tightly enveloped by a foil.

36. A method as defined in claim 35, wherein said enveloping foil comprises a synthetic plastic material.

37. A method as defined in claim 30, wherein a heat-resistant synthetic plastic layer is interposed between said element and said protuberances.

38. A method as defined in claim 37, wherein said layer has resistance-heating wires embedded in it; and further comprising the step of energizing said wires.

* * * * *